US007658006B2

(12) United States Patent
Schroeder

(10) Patent No.: US 7,658,006 B2
(45) Date of Patent: Feb. 9, 2010

(54) METHOD OF MANUFACTURING A HANDLE FOR A BEVERAGE DISPENSING HEAD

(75) Inventor: Alfred A. Schroeder, San Antonio, TX (US)

(73) Assignee: Schroeder Industries Inc., San Antonio, TX (US)

( * ) Notice: Subject to any disclaimer, the term of this patent is extended or adjusted under 35 U.S.C. 154(b) by 502 days.

(21) Appl. No.: 11/701,324

(22) Filed: Feb. 1, 2007

(65) Prior Publication Data

US 2008/0223876 A1 Sep. 18, 2008

(51) Int. Cl.
*B65D 5/56* (2006.01)

(52) U.S. Cl. ..... 29/890.142; 29/890.144; 264/238; 425/577; 222/144.5; 222/129.1

(58) Field of Classification Search ..... 222/144.5, 222/129.1; 29/890.144, 890.142; 264/238; 425/577; 200/293.1, 332.2
See application file for complete search history.

(56) References Cited

U.S. PATENT DOCUMENTS 4,921,140 A * 5/1990 Belcham ..... 222/144.5
4,986,449 A 1/1991 Valiyee et al. ..... 222/144.5
6,322,051 B1 11/2001 Salmela ..... 251/321

* cited by examiner

*Primary Examiner*—Sam Chuan C Yao
*Assistant Examiner*—Christopher Besler
(74) *Attorney, Agent, or Firm*—Christopher L. Makay

(57) ABSTRACT

In a method of manufacturing a beverage dispensing head, a first section is molded to include an exit channel and a first portion of a valve bore. A second section is molded to include an entry channel, a passage through the second section, and a second portion of the valve bore. A third section is molded to include a passage through the third section and a third portion of the valve bore. The first section is mated with the second section and the second section is mated with the third section to form a handle including a passageway therethrough. The mating of the first section with the second section and the second section with the third section aligns the first portion with the second portion and the second portion with the third portion to form the valve bore for the passageway. In addition, the entry channel is sealed to form a fluid entry aperture and a fluid entry conduit for the passageway. Further, the exit channel is sealed to form a portion of a fluid exit conduit for the passageway. Still further, the exit channel aligns with the passages to form a portion of the fluid exit conduit and to provide a fluid exit aperture for the passageway. After forming the handle, a valve assembly is placed within the valve bore, and a valve actuator assembly is mounted onto the handle. A nozzle is secured to the handle such that the fluid exit aperture communicates with the nozzle.

6 Claims, 5 Drawing Sheets

METHOD OF MANUFACTURING A HANDLE FOR A BEVERAGE DISPENSING HEAD

BACKGROUND OF THE INVENTION

1. Field of the Invention

The present invention relates to a beverage dispensing head, and, more particularly, but not by way of limitation, to a method of manufacturing a handle for a beverage dispensing head.

2. Description of the Related Art

A beverage dispensing apparatus typically termed a "bar gun" includes a beverage dispensing head and a brixing device coupled to the dispensing head through a flexible line having a plurality of hoses therein. A beverage component source supplies the brixing device with base fluids and mixing fluids at elevated pressures. Base fluids include beverage syrups, juices, wine, and liquor, while mixing fluids include plain and carbonated water.

The beverage dispensing head includes a handle with a plurality of passageways therethrough whereby each hose within the flexible line connects with a passageway through a suitable retainer. Each passageway communicates either a base fluid or a mixing fluid through the handle to a nozzle frictionally secured to the handle via o-rings. The passageways each include a fluid entry aperture fluidly coupled with a fluid entry conduit, a fluid exit conduit fluidly coupled with a fluid exit aperture, and a valve bore fluidly coupled with both the fluid entry conduit and the fluid exit conduit. The valve bore includes an annular shoulder forming a valve seat, wherein the portion of the valve bore below the valve seat is a fluid entry chamber fluidly coupled with the fluid entry conduit, and the portion of the valve bore above the valve seat is a fluid exit chamber fluidly coupled with the fluid exit conduit. Each valve bore includes a valve assembly that controls the passage of fluids through a respective passageway. Moreover, a valve actuator assembly mounts onto the handle to control the operation of each valve assembly.

The inclusion of multiple passageways in the handle necessitates construction of the handle from multiple sections. The number of sections is dictated by the number of base and mixing fluids, with four sections being a typical number. Each section is machined separately from a transparent acrylic material or suitable plastic. Specifically, each section is machined to a desired size and shape, including the machining therein of channels, apertures, and holes that form the conduits and valve bores when the sections are assembled into the handle. Assembly includes stacking the sections in the correct order such that the channels, apertures, and holes align to form the conduits and valve bores as previously described. The sections are held in place in proper alignment through the use of a bonding agent such as glue or solvent to create a watertight seal for each layer.

While machining each section individually and assembling the sections into a handle produces handles suitable for use in beverage dispensing heads, the machining process in general suffers disadvantages. In particular, the machining process is time-consuming and relatively expensive because each section is machined individually through a multi-step process, and each step increases both machine time and overall cost. Moreover, a single section for one handle requires the same amount of time and labor to manufacture as the same section for another handle. Accordingly, the per unit cost of each section remains constant regardless of how many sections are made. As such, there is no significant per unit reduction in cost for mass-production. Furthermore, the tolerances that must be maintained to ensure the sections fit properly increase costs as well. Tools used to create the machined sections require constant calibration because of various factors. For example, the heat generated from the drilling of a channel or hole in a machined section can alter the size and shape of a component for a drilling device, thereby affecting the dimensions of the channel or hole created. Vibrations from motors can cause parts on machining tools to move, which can change the position of where a section is cut. In both examples, the result could be machined sections with holes and channels that do not align properly, rendering the sections useless. Machining therefore requires more labor and down-time because of the increased need for quality control measures that ensure the sections fit properly.

Accordingly, a method of manufacturing sections for a handle of a beverage dispensing head that reduces both manufacturing time and cost over the current method of machining would be an improvement.

SUMMARY OF THE INVENTION

In accordance with the present invention, a method of manufacturing a beverage dispensing head injection molds a plastic or other suitable material into at least three handle sections that are mated to form a handle for the beverage dispensing head. The at least three handle sections include channels, portions of a valve bore, and passages such that, when the at least three handle sections are mated, the channels, portions, and passages align to form at least one passageway through the handle. The passageway once formed includes a fluid entry aperture fluidly coupled with a fluid entry conduit, a fluid exit conduit fluidly coupled with a fluid exit aperture, and a valve bore fluidly coupled with both the fluid entry conduit and the fluid exit conduit. The valve bore includes a valve assembly therein that controls the passage of a fluid through the passageway. Moreover, a valve actuator assembly mounts onto the handle to control the operation of each valve assembly.

It is therefore an object of the present invention to provide a method of manufacturing a handle for a beverage dispensing head through the mass production technique of injection molding, whereby injection molding handle sections lowers the time and per unit cost of producing the handle as compared to the standard method of machining handle sections.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

BRIEF DESCRIPTIONS OF THE DRAWINGS

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

The present invention described herein employs injection molding techniques to manufacture handle sections that assemble into a handle for a beverage dispensing head. In particular, various molds with core components complimentary in shape to a desired handle section are utilized to mold handle sections from suitable injection molding materials, such as plastic. The handle sections are molded to contain channels, apertures, and holes such that, upon assembly of the handle sections into a handle, the channels, apertures, and holes align to create passageways and conduits, and permit fluid flow through the handle when desired.

Manufacturing handle sections through injection molding presents advantages in that injection molding is a preferred method for producing complex shapes of various sizes having very fine details. The handle sections produced through injection molding have greater dimensional control, and, once successful molds are developed, tolerance levels significantly better than that of machining may be maintained. The resulting handle sections accordingly have more exact tolerances than machined sections, resulting in sections that fit together properly to achieve fluid passageways and conduits capable of adequate flow rates and watertight seals that prevent leakage. Furthermore, constant calibration of cutting and drilling tools is not required, resulting in less labor and less downtime as well as a significant reduction in quality control issues. Still further, injection molding is better suited than machining for producing handle sections in large quantities because, once molds are developed, the per unit cost of the handle sections is much less than that for machining.

Figure 1:
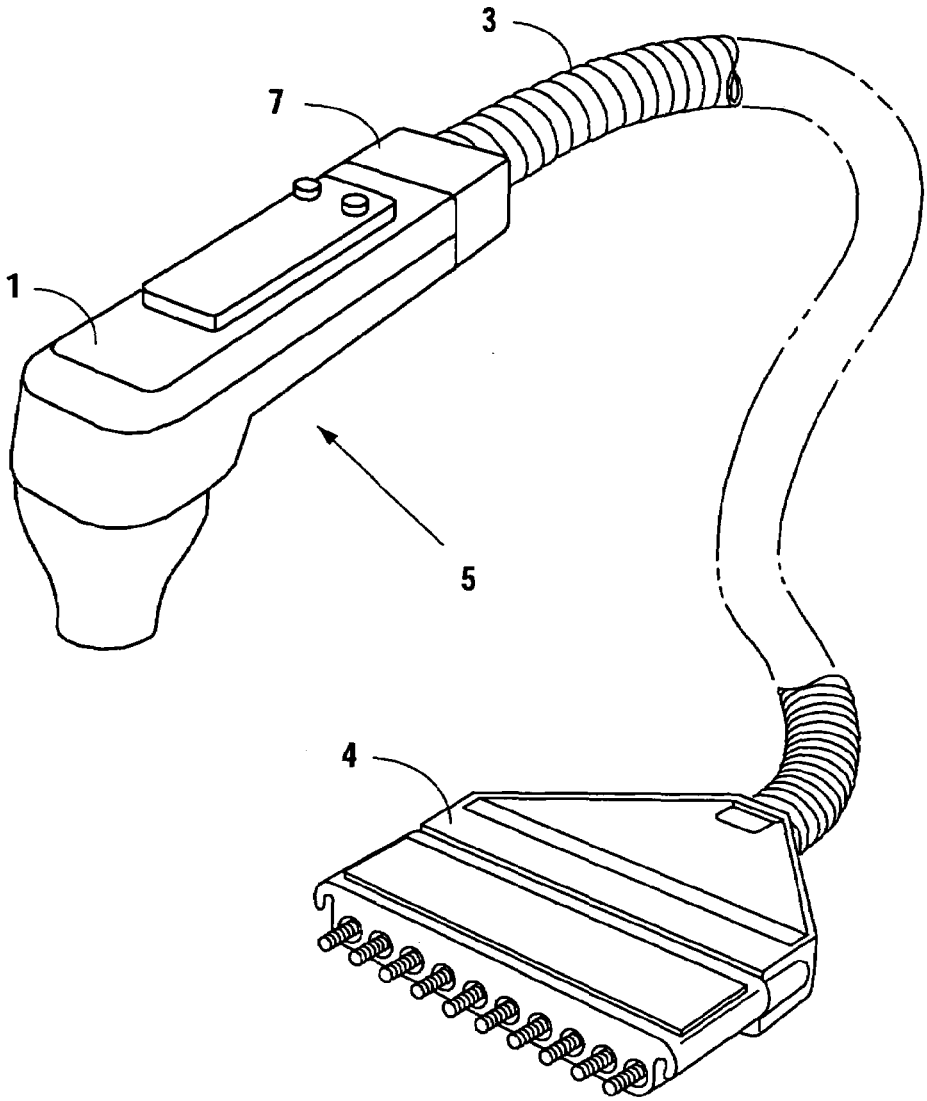
FIG. 1 is an overall perspective view illustrating a beverage dispensing apparatus according to a first embodiment.
Figure 2:
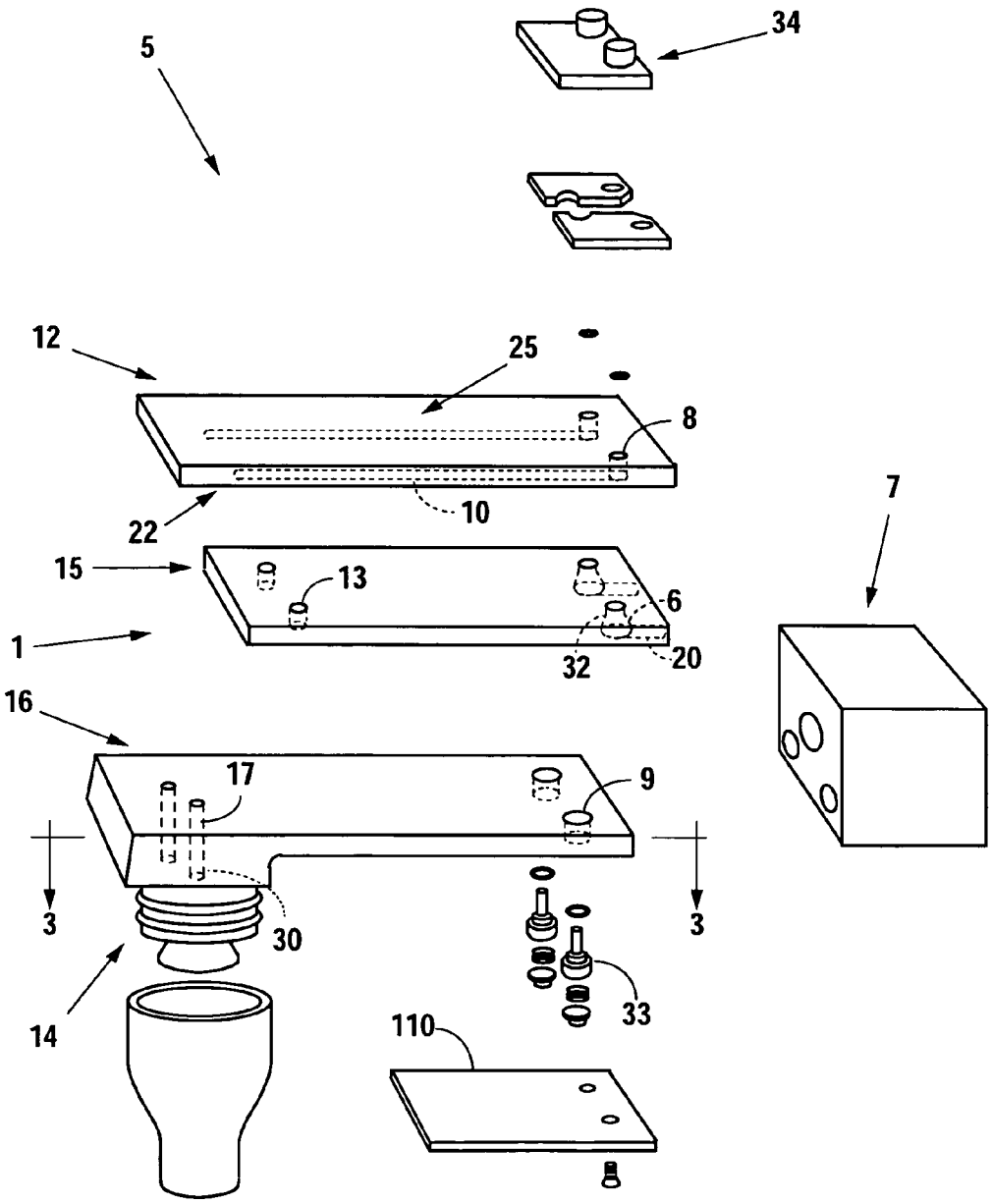
FIG. 2 is an exploded perspective view illustrating a handle for a beverage dispensing head according to the first embodiment.
Figure 3:
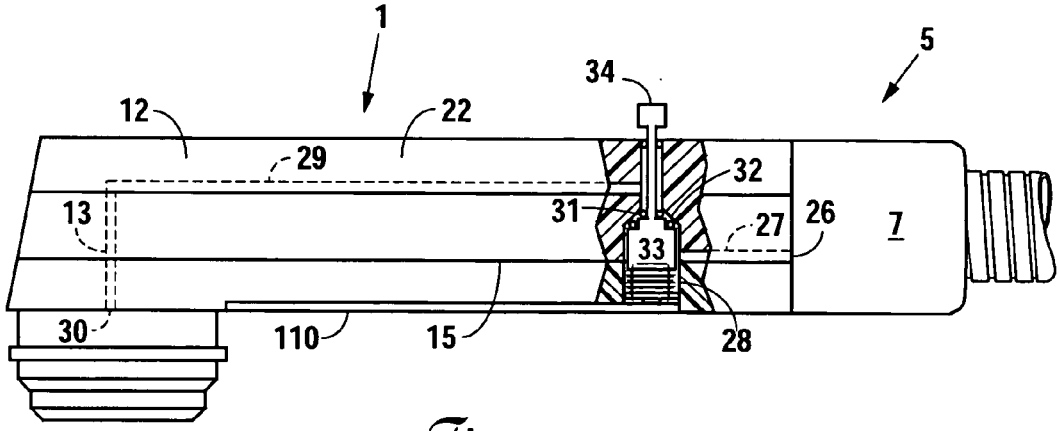
FIG. 3 is a side elevation view in cross-section taken along lines 3,3 of FIG. 2 illustrating a fluid pathway in the beverage dispensing head according to the first embodiment.
Figure 4:
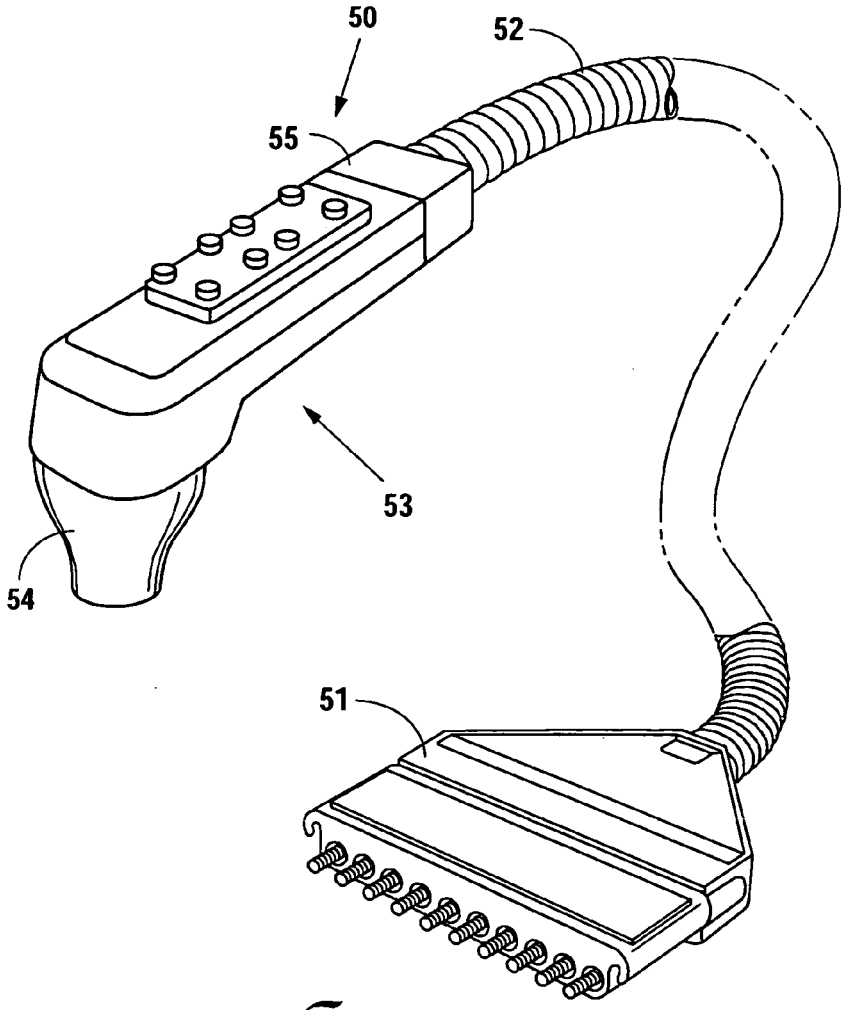
FIG. 4 is an overall perspective view illustrating a beverage dispensing apparatus according to a second embodiment.
Figure 5:
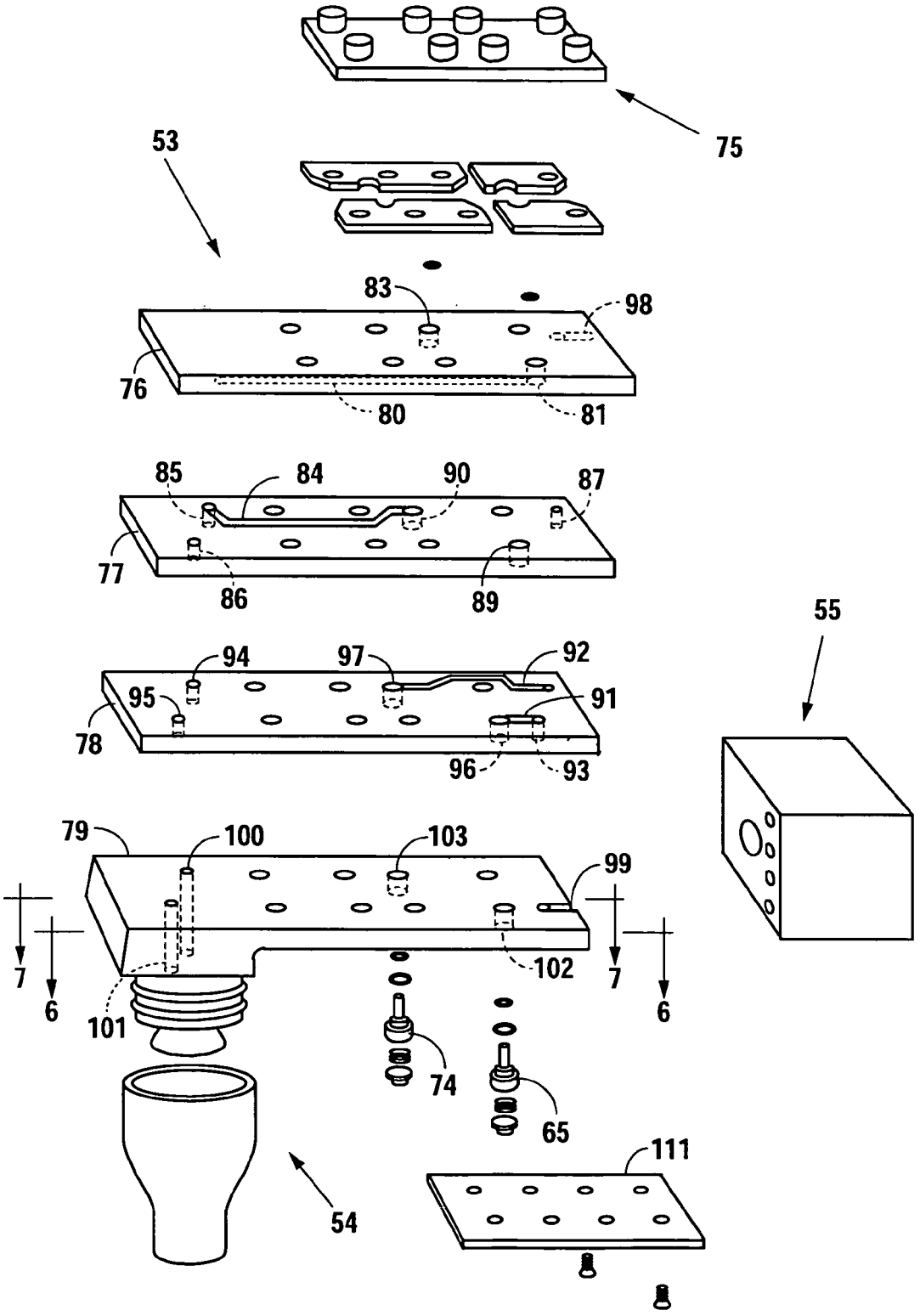
FIG. 5 is an exploded perspective view illustrating a handle for a beverage dispensing head according to the second embodiment.
Figure 6:
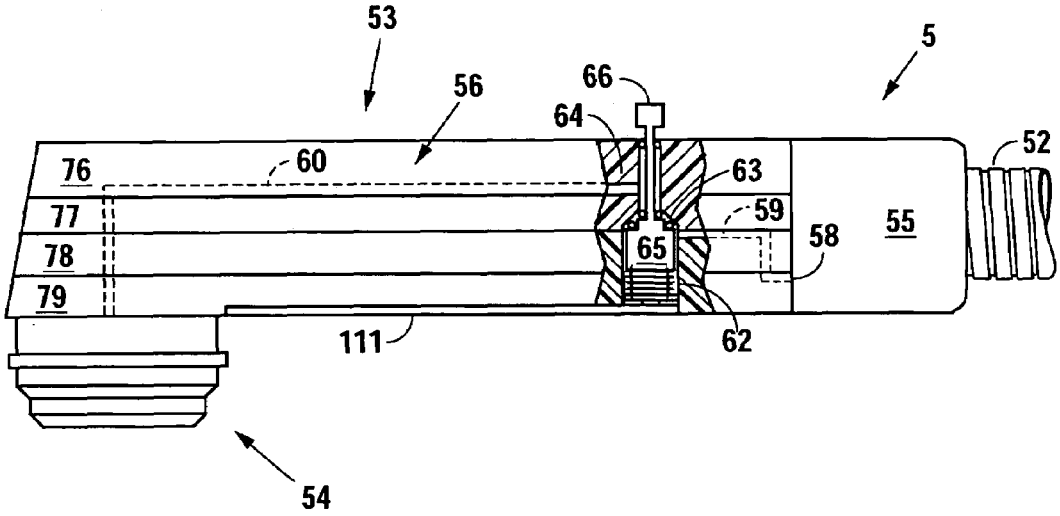
FIG. 6 is a side elevation view in cross-section taken along lines 6,6 of FIG. 5 illustrating one fluid pathway in the beverage dispensing head according to the second embodiment.
Figure 7:
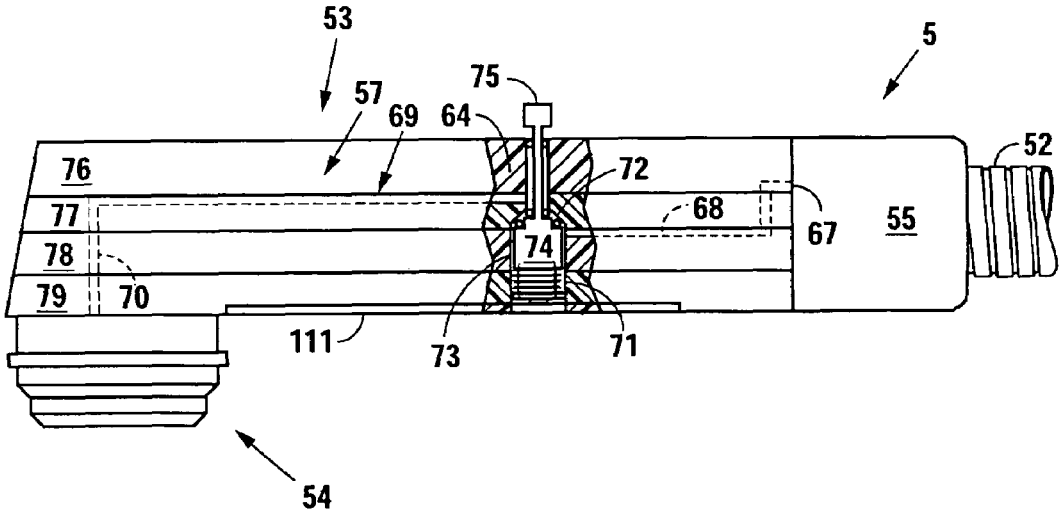
FIG. 7 is a side elevation view in cross-section taken along lines 7,7 of FIG. 5 illustrating a second fluid pathway in the beverage dispensing head according to the second embodiment.

As illustrated in FIGS. 1-3, a beverage dispensing apparatus according to a first embodiment is adapted to dispense into appropriate receptacles, such as glasses or cups, a base fluid and a mixing fluid, two base fluids, or two mixing fluids. Base fluids include beverage syrups, juices, wine, and liquor, while mixing fluids include plain and carbonated water. While the beverage dispensing apparatus according to the first embodiment is capable of dispensing two fluids, it should be understood that, for proper operation, the beverage dispensing apparatus only must be capable of dispensing one fluid. Moreover, the beverage dispensing apparatus may be modified to dispense more than two fluids as disclosed more fully herein with reference to FIGS. 4-7.

The beverage dispensing apparatus according to the first embodiment includes a beverage dispensing head 5, a brixing device 4, and a flexible line 3 including two hoses that couple the brixing device 4 to the beverage dispensing head 5. A beverage component source supplies the brixing device 4 with a base fluid and a mixing fluid, two base fluids, or two mixing fluids at elevated pressures.

The beverage dispensing head 5 includes a handle 1 with passageways 22 and 25 therethrough that communicate with a nozzle 14 secured to the handle 1. The beverage dispensing head 5 further includes and a retaining cap 7 that couples a first hose of the flexible line 3 with the passageway 22 and a second hose of the flexible line 3 with the passageway 25. The first hose supplies a base fluid or a mixing fluid from the brixing device 4 to the passageway 22, and the second hose supplies a base fluid or a mixing fluid from the brixing device 4 to the passageway 25. Each of the passageways 22 and 25 communicates the base fluid or the mixing fluid through the handle 1 and to the nozzle 14 which delivers the base fluid or mixing fluid from the beverage dispensing head 5.

The passageway 25 is identical to the passageway 22. Consequently, only the passageway 22 will be described in detail. The passageway 22 includes a fluid entry aperture 26 fluidly coupled with a fluid entry conduit 27, a fluid exit conduit 29 fluidly coupled with a fluid exit aperture 30, and a valve bore 28 fluidly coupled with both the fluid entry conduit 27 and the fluid exit conduit 29. The valve bore 28 includes an annular shoulder 31 forming a valve seat 32, wherein the fluid entry conduit 27 communicates with the portion of the valve bore 28 below the valve seat 32, and the fluid exit conduit 29 communicates with the portion of the valve bore 28 above the valve seat 32. A valve assembly 33 resides in the valve bore 32 and controls the passage of fluid through the passageway 22. A plate 110 secured to the handle 1 using any suitable means such as screws retains the valve assembly 33 within the valve bore 32. Moreover, a valve actuator assembly 34 mounts onto the handle 1 to control the operation of the valve assembly 33.

The handle 1 includes a first section 12, a second section 15, and a third section 16 that assemble into the handle 1 and align to define the first passageway 22 and the second passageway 25. During an injection molding process, a suitable material, such as plastic, is injected into a mold complementary in shape to that desired for the first section 12. In particular, the mold includes core components complimentary in shape for the formation of an exit channel 10 in the bottom of the first section 12 and a first portion 8 of the valve bore 28. Similarly, a suitable material such as plastic is injected into a mold complementary in shape to that desired for the second section 15. In particular, the mold includes core components complimentary in shape for the formation of an entry channel 20 in the bottom of the second section 15, a passage 13 through the second section 15, and a second portion 6 of the valve bore 28 through the second section 15 which includes the valve seat 32. Likewise, a suitable material such as plastic is injected into a mold complementary in shape to that desired for the second section 16. In particular, the mold includes core components complimentary in shape for the formation of a passage 17 through the second section 15 and a third portion 9 of the valve bore 28.

The placement of the first section 12 on top of the second section 15 and the second section 15 on top of the third section 16 with the proper alignment forms the passageway 22. In particular, the first section 12 is placed on top of the second section 15 and the second section 15 on top of the third section 16 such that the first portion 8 mates with the second portion 6 and the second portion 6 mates with the third portion 9 to form the completed valve bore 28. Furthermore, the second section 15 seals the exit channel 10, thereby forming a portion of the fluid exit conduit 29, and the third section 16 seals the entry channel 20, thereby forming the fluid entry aperture 26 and the fluid entry conduit 27. Moreover, the first section 12 is placed on top of the second section 15 such that the end of the exit channel 10 opposite to the valve bore 28 mates with the passage 13, thereby forming a portion of the fluid exit conduit 29, and the second section 15 is placed on top of the third section 16 such that the passage 13 mates with the passage 17, thereby completing the fluid exit conduit 29 and providing the fluid exit aperture 30. The placement of the first section 12 on top of the second section 15 and the second section 15 on top of the third section 16 with the proper alignment also forms the passageway 25, as the passageway 25 is identical to the passageway 22. The first section 12, the second section 15, and the third section 16 are bonded together using any suitable means to create a watertight and leak-proof seal, such as an adhesive, solvent, screws or the like.

It should be understood that the locations of the fluid entry aperture 26 and the fluid entry conduit 27 in the second section 15 and the majority of the fluid exit conduit 29 in the first section are exemplary only, and that the locations may be different such as, for example, the fluid entry aperture 26 and the fluid entry conduit 27 may be in the first section 12 or the third section 16 while the fluid exit conduit 29 may be in the second section. Further, it should be understood that, while the channels have been described as located in a single section 12, 15, or 16, a complementary channel in an opposite section 12, 15, or 16 might be included. Still further, it should be understood that, where appropriate, a pin may be inserted into a section mold for the formation an actual conduit through the section rather than a channel.

Once the handle 1 is formed, the beverage dispensing head 5 may be assembled. The beverage dispensing head 5 is assembled through placing the valve assembly 33 within the valve bore 32, and mounting the valve actuator assembly 34 onto the handle 1. The plate 110 is then secured to the handle 1. Moreover, the nozzle 14 is secured to the handle 1, and the retaining cap 7 is employed to connect the flexible line 3 to the handle 1.

In use, a beverage component source supplies the brixing device 4 with a base fluid or a mixing fluid at an elevated pressure, which is delivered from the flexible line 3 into the fluid entry conduit 27 via the fluid entry aperture 26. Upon activation of the valve actuator assembly 34, the valve assembly 33 moves such that the fluid entry conduit 27 delivers the base fluid or the mixing fluid through the valve bore 28 and into the fluid exit conduit 29. The base fluid or the mixing travels through the fluid exit conduit 29 and exits the handle 1 into the nozzle 14 through fluid exit aperture 30. The base fluid or the mixing exits the nozzle 14 for delivery into an appropriate receptacle.

As illustrated in FIGS. 4-7, a beverage dispensing apparatus according to a second embodiment is adapted to dispense into appropriate receptacles, such as glasses or cups, eight fluids, which may be eight base fluids, eight mixing fluids, or any combination of base and mixing fluids. While the beverage dispensing apparatus according to the second embodiment is capable of dispensing eight fluids, it should be understood that fewer fluids including only one might be dispensed. Moreover, and as limited only by reasonable size requirements, the beverage dispensing apparatus may be modified to dispense more than eight fluids.

The beverage dispensing apparatus according to the second embodiment includes a beverage dispensing head 50, a brixing device 51, and a flexible line 52 including eight hoses that couple the brixing device 51 to the beverage dispensing head 50. A beverage component source supplies the brixing device 51 with eight base fluids, eight mixing fluids, or any combination of base and mixing fluids.

The beverage dispensing head 50 includes a handle 53 with eight passageways therethrough that communicate with a nozzle 54 frictionally secured to the handle 53 via o-rings. The beverage dispensing head 50 further includes and a retaining cap 55 that couples each of the eight hoses of the flexible line 52 with a respective passageway. Each of the hoses supplies a base fluid or a mixing fluid from the brixing device 51 to a respective passageway. Similarly, each passageway communicates the base fluid or the mixing fluid through the handle 53 and to the nozzle 54 which delivers the base fluid or mixing fluid from the beverage dispensing head 50.

While the handle 53 includes eight passageways, only passageways 56 and 57 will be described herein because each of the passageways is identical, except their paths through the handle 53 must vary to allow incorporation therein. Accordingly, it should be understood that the passageways 56 and 57 are illustrative examples of paths through the handle 53 and that there are many other potential paths.

The passageway 56 includes a fluid entry aperture 58 fluidly coupled with a fluid entry conduit 59, a fluid exit conduit 60 fluidly coupled with a fluid exit aperture 61, and a valve bore 62 fluidly coupled with both the fluid entry conduit 59 and the fluid exit conduit 60. The valve bore 62 includes an annular shoulder 63 forming a valve seat 64, wherein the fluid entry conduit 59 communicates with the portion of the valve bore 62 below the valve seat 64, and the fluid exit conduit 60 communicates with the portion of the valve bore 62 above the valve seat 64. A valve assembly 65 resides in the valve bore 62 and controls the passage of fluid through the passageway 56. A plate 111 secured to the handle 53 using any suitable means such as screws retains the valve assembly 65 within the valve bore 62. Moreover, a valve actuator assembly 66 mounts onto the handle 53 to control the operation of the valve assembly 65.

Similarly, the passageway 57 includes a fluid entry aperture 67 fluidly coupled with a fluid entry conduit 68, a fluid exit conduit 69 fluidly coupled with a fluid exit aperture 70, and a valve bore 71 fluidly coupled with both the fluid entry conduit 68 and the fluid exit conduit 69. The valve bore 71 includes an annular shoulder 72 forming a valve seat 73, wherein the fluid entry conduit 68 communicates with the portion of the valve bore 71 below the valve seat 73, and the fluid exit conduit 69 communicates with the portion of the valve bore 71 above the valve seat 73. A valve assembly 74 resides in the valve bore 71 and controls the passage of fluid through the passageway 57. The plate 111 retains the valve assembly 74 within the valve bore 71. Moreover, a valve actuator assembly 75 mounts onto the handle 53 to control the operation of the valve assembly 74.

The handle 53 includes a first section 76, a second section 77, a third section 78, and a fourth section 79 that assemble into the handle 53 and align to define the passageway 56 and the second passageway 57, as well as the other passageways. During an injection molding process, a suitable material, such as plastic, is injected into a mold complementary in shape to that desired for the first section 76. In particular, the mold includes core components complimentary in shape for the formation of a first portion 81 of the valve bore 62 through the first section 76, a first portion 83 of the valve bore 71 through the first section 76, an entry channel 98 in the bottom of the first section 76, and an exit channel 80 in the bottom of the first section 76 that communicates with the first portion 81. In addition, a suitable material such as plastic is injected into a mold complementary in shape to that desired for the second section 77. In particular, the mold includes core components complimentary in shape for the formation of a second portion 89 of the valve bore 62 through the second section 77 which includes the valve seat 64, and a second portion 90 of the valve bore 71 through the second section 77 which includes the valve seat 73, an exit channel 84 in the top of the second section 77 that communicates with the second portion 90, a passage 85 through the second section 77 that communicates with the end of the exit channel 84 opposite from the second portion 90, and passages 86 and 87 through the second section 77. Further, a suitable material such as plastic is injected into a mold complementary in shape to that desired for the third section 78. In particular, the mold includes core components complimentary in shape for the formation of a third portion 96 of the valve bore 62 through the third section 78, a third portion 97 of the valve bore 71 through the third section 78, an entry channel 91 in the top of the third section 78 that communicates with the third portion 96, an entry channel 92 in the top of the third section 78 that communicates with the third portion 97, and passages 94 and 95 through the third section 78. Still further, a suitable material such as plastic is injected into a mold complementary in shape to that desired for the fourth section 79. In particular, the mold includes core components complimentary in shape for the formation of a fourth portion 102 of the valve bore 62 through the fourth section 79, a fourth portion 103 of the valve bore 71 through the fourth section 79, an entry channel 99 in the top of the fourth section 79, and passages 100 and 101 through the fourth section 79.

The stacking of the first through the fourth sections 76-79 in the proper alignment forms the passageways 56 and 57. In particular, the first through the fourth sections 76-79 mate such that the first portion 81, the second portion 89, the third portion 96, and the fourth portion 102 align to form the completed valve bore 62. Likewise, the first portion 83, the second portion 90, the third portion 97, and the fourth portion 103 align to form the completed valve bore 71. Moreover, the first section 76 and the second section 77 mate such that the exit channel 80 is sealed and the end of the exit channel 80 opposite from the first portion 81 aligns with the passage 86 to form a portion of the fluid exit conduit 60. Further, the entry channel 98 is sealed to form the fluid entry aperture 68, and the end of the entry channel 98 opposite to the fluid entry aperture 68 aligns with the passage 87 to form a portion of the fluid entry conduit 68. Still further, the exit channel 84 is sealed to form a portion of the fluid exit conduit 69. The second section 77 and the third section 78 mate such that the entry channel 91 is sealed to form a portion of the fluid entry conduit 59. Further, the entry channel 92 is sealed and the end of the entry channel 92 opposite from the third portion 97 aligns with the passage 87 to form with the passage 87 a portion of the fluid entry conduit 68. Still further, the passage 86 aligns with the passage 95 to form a portion of the fluid exit conduit 60, and the passage 85 aligns the passage 94 to form with the passage 94 a portion of the fluid exit conduit 69. The third section 78 and the fourth section 79 mate such that the entry channel 99 is sealed to form the fluid entry aperture 58, and the end of the entry channel 99 opposite to the fluid entry aperture 58 aligns with the passage 93 to form with the passage 93 a portion of the fluid entry conduit 59. Further, the passage 95 aligns with the passage 101 to form a portion of the fluid exit conduit 60 and provide the fluid exit aperture 61, and the passage 94 aligns with the passage 100 to form a portion of the fluid exit conduit 69 and provide the fluid exit aperture 70. The first through the fourth sections 76-79 are bonded together using any suitable means to create a water-tight and leak-proof seal, such as an adhesive, solvent, screws or the like.

It should be understood that the locations of the fluid entry apertures 58 and 67, the fluid entry conduits 59 and 68, and the fluid exit conduits 60 and 69 are exemplary only, and that those locations as well as the locations for portions of the other passageways may be changed such as, for example, the fluid entry aperture 58 and the fluid entry conduit 59 may be in the second and third sections 78 and 79, while the fluid exit conduit 60 may traverse the first through the fourth sections differently. Further, it should be understood that, while the channels have been described as located in a single section 76, 77, 78, or 79, a complementary channel in an opposite section 76, 77, 78, or 79 might be included. Still further, it should be understood that, where appropriate, a pin may be inserted into a section mold for the formation an actual conduit through the section rather than a channel.

Once the handle 53 is formed, the beverage dispensing head 50 may be assembled. The beverage dispensing head 50 is assembled through placing the valve assembly 65 within the valve bore 62, and mounting the valve actuator assembly 66 onto the handle 53. Likewise, the valve assembly 74 is placed within the valve bore 71, and the valve actuator assembly 75 is mounted onto the handle 53. The plate 111 is then secured to the handle 53. Moreover, the nozzle 54 is frictionally secured to the handle 53 via o-rings, and the retaining cap 55 is employed to connect the flexible line 52 to the handle 53.

In use, a beverage component source supplies the brixing device 51 with a base fluid or a mixing fluid at an elevated pressure, which is delivered from the flexible line 52 into the fluid entry conduit 59 via the fluid entry aperture 58. Upon activation of the valve actuator assembly 66, the valve assembly 65 moves such that the fluid entry conduit 59 delivers the base fluid or the mixing fluid through the valve bore 62 and into the fluid exit conduit 60. The base fluid or the mixing travels through the fluid exit conduit 60 and exits the handle 53 into the nozzle 54 through fluid exit aperture 61. The base fluid or the mixing exits the nozzle 54 for delivery into an appropriate receptacle. Similarly, the beverage component source supplies the brixing device 51 with a base fluid or a mixing fluid at an elevated pressure, which is delivered from the flexible line 52 into the fluid entry conduit 68 via the fluid entry aperture 67. Upon activation of the valve actuator assembly 75, the valve assembly 74 moves such that the fluid entry conduit 68 delivers the base fluid or the mixing fluid through the valve bore 71 and into the fluid exit conduit 69. The base fluid or the mixing travels through the fluid exit conduit 69 and exits the handle 53 into the nozzle 54 through fluid exit aperture 70. The base fluid or the mixing exits the nozzle 54 for delivery into an appropriate receptacle.

Although the present invention has been described in terms of the foregoing preferred embodiments, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

I claim:

1. A method of manufacturing a beverage dispensing head, comprising:

molding a first section including an exit channel and a first portion of a valve bore;

molding a second section including an exit channel, a passage through the second section that communicates with the exit channel, and a second portion of the valve bore;

molding a third section including an entry channel, a first passage through the third section that communicates with the entry channel, a second passage through the third section, and a third portion of the valve bore;

molding a fourth section including an entry channel, a passage through the fourth section, and a fourth portion of the valve bore;

mating the first, second, third, and fourth sections to form a handle including a passageway therethrough, whereby:

the first, second, third, and fourth portions align to form the valve bore for the passageway, the exit channel in the first section and the exit channel in the second section are sealed and align to form with the passage through the second section a portion of a fluid exit conduit for the passageway, the entry channel in the third section is sealed to form with the first passage through the third section a portion of a fluid entry conduit for the passageway, the passage through the second section aligns with the second passage through the third section to form a portion of the fluid exit conduit for the passageway, the entry channel of the fourth section is sealed to provide a fluid entry aperture for the passageway, the entry channel of the fourth section aligns with the first passage through the third section to form a portion of the fluid entry conduit for the passageway, and the second passage through the third section aligns with the passage through the fourth section to form a portion of the fluid exit conduit and provide a fluid exit aperture for the passageway; and placing a valve assembly within the valve bore;

mounting a valve actuator assembly onto the handle; and securing a nozzle to the handle, whereby the fluid exit aperture communicates with the nozzle.

2. The method of manufacturing a beverage dispensing head according to claim 1, further comprising securing a plate to the handle thereby retaining the valve assembly within the handle.

3. The method of manufacturing a beverage dispensing head according to claim 1, further comprising mounting a retaining cap to the handle.

4. The method of manufacturing a beverage dispensing head according to claim , wherein the valve bore includes a valve seat therein.

5. The method of manufacturing a beverage dispensing head according to claim 4, wherein the fluid entry conduit communicates with a portion of the valve bore below the valve seat.

6. The method of manufacturing a beverage dispensing head according to claim 5, wherein the fluid exit conduit communicates with a portion of the valve bore above the valve seat.

* * * * *